United States Patent [19]

Ericson

[11] Patent Number: 4,462,193

[45] Date of Patent: Jul. 31, 1984

[54] ELEVATOR CAB

[75] Inventor: Richard J. Ericson, Southington, Conn.

[73] Assignee: Otis Elevator Company, Farmington, Conn.

[21] Appl. No.: 385,629

[22] Filed: Jun. 4, 1982

Related U.S. Application Data

[63] Continuation-in-part of Ser. No. 294,600, Aug. 20, 1981, Pat. No. 4,430,835.

[51] Int. Cl.[3] ..... E04B 1/00

[52] U.S. Cl. ..... 52/282; 52/264; 52/483; 52/DIG. 13; 24/306; 411/548

[58] Field of Search ..... 52/281, 282, 264, 483, 52/DIG. 13; 24/204, 306; 411/548

[56] References Cited

U.S. PATENT DOCUMENTS

| | | | |
|---|---|---|---|
| 1,616,095 | 2/1927 | Van Dorn et al. | 52/282 |
| 2,063,010 | 12/1936 | Balduf | 52/281 |
| 2,300,449 | 11/1942 | Rowe | 52/483 |
| 2,324,326 | 7/1943 | Schwendt | 52/483 |
| 2,838,592 | 6/1958 | Feketics | 52/282 |
| 2,924,638 | 2/1960 | Feketics | 52/282 |
| 3,017,970 | 1/1962 | Nichols | 52/483 |
| 3,485,405 | 12/1969 | Dement | 52/282 |
| 3,507,315 | 4/1970 | Tummarello | 52/483 |
| 3,517,468 | 6/1970 | Woods | 52/309.8 |
| 3,572,002 | 3/1971 | Nichols | 52/86 |
| 3,658,107 | 4/1972 | Perina | 24/204 |
| 3,664,076 | 5/1972 | McCoy | 52/264 |
| 3,721,050 | 3/1973 | Perina | 52/DIG. 13 |
| 3,807,112 | 4/1974 | Perina | 52/DIG. 13 |
| 3,837,989 | 9/1974 | McCoy | 52/264 |
| 4,041,667 | 8/1977 | Lindner et al. | 52/483 |

*Primary Examiner*—John E. Murtagh
*Assistant Examiner*—Michael Safavi
*Attorney, Agent, or Firm*—Robert E. Greenstien

[57] ABSTRACT

An elevator cab is constructed of thin, somewhat semi-rigid skeleton. Panels, made of expanded core plastic, or honeycomb paper, are attached to the skeleton, thereby forming a very light and rigid cab. These panels are attached by means of releasable hook-like fasteners, thus permitting selective removal of the panels from the skeleton. Due to strategic location of the fasteners on the skeleton, the panels, when attached to the skeleton, create a rigid cab.

3 Claims, 4 Drawing Figures

FIG. 2
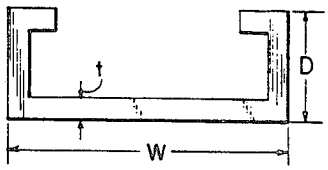
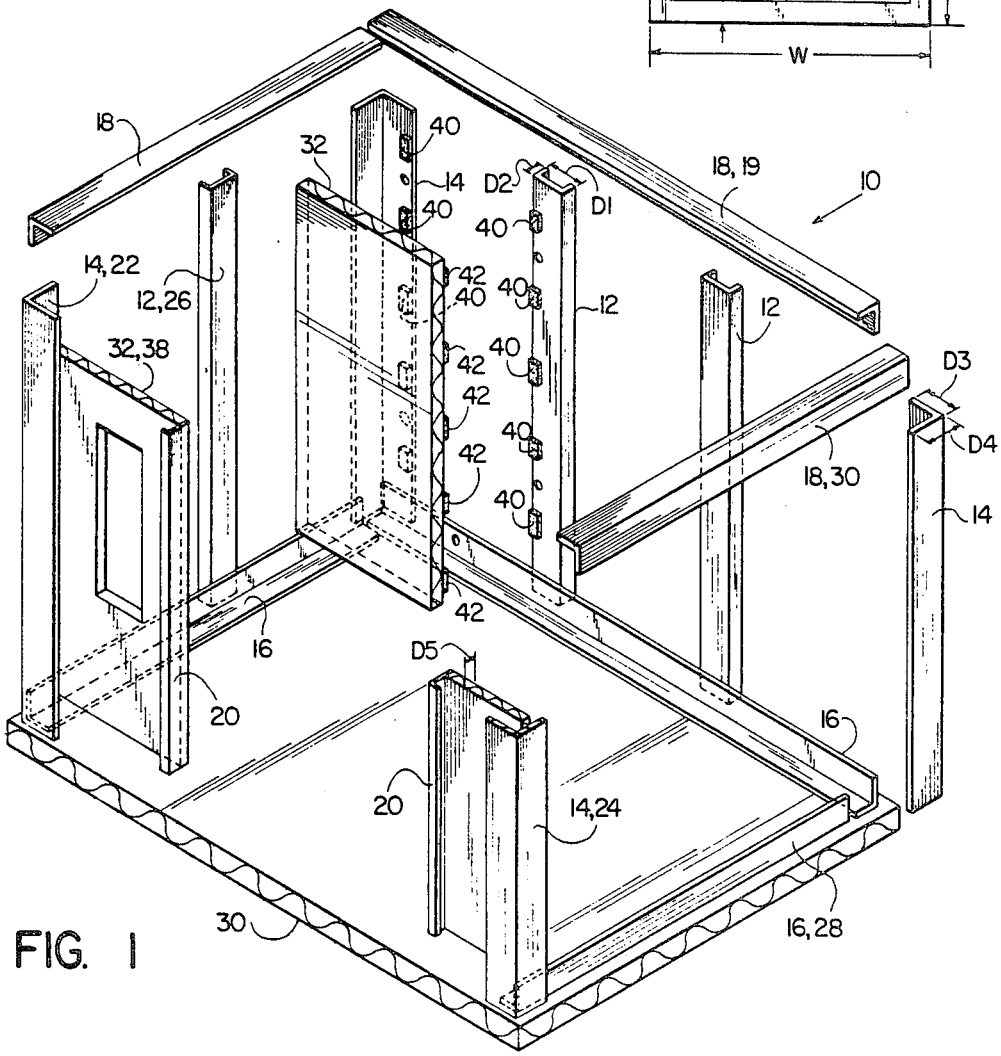
FIG. 1

ELEVATOR CAB

This is a continuation-in-part of application Ser. No. 294,600, filed on Aug. 20, 1981 now U.S. Pat. No. 4,430,835.

DESCRIPTION

TECHNICAL FIELD

This invention relates to the construction of elevator cabs.

BACKGROUND ART

In elevator systems, passengers ride in a car comprising a cab which is suspended on a frame to which the car lifting equipment is attached. Many elevator cabs have a rigid, sturdy frame to which decorative panels, functioning solely as walls, are attached in order to provide a passenger enclosure. The cab rigidity of cabs constructed this way is primarily a function of the rigidity of the frame, not the walls. Also, cabs constructed this way are generally expensive and typically heavy, mainly due to the use of a heavy frame in order to give the cab rigidity. A heavy cab, of course, requires larger elevator components, most significantly a more powerful elevator drive, which thus also wastes more energy than a lower power motor. Drive power also limits acceleration. And, in hydraulic elevators the weight is even more critical, since there is no regeneration to speak of. Hence, by achieving a substantial reduction in the cab weight, it becomes possible to reduce excess mass in the system by reducing both the number of ropes in the system and the counterweight mass, and thereby provide a lower cost, energy efficient elevator.

Other cab construction approaches are found in the prior art, and these have focused mainly on reducing the cost of the cab, or aesthetic appeal, not necessarily weight. Generally speaking, prior art cab design criteria have focused on cost reduction, underestimating, if not ignoring, the negative effects from excess system mass, which is present when a cab is heavier than it has to be. One, using a modified "monoque" construction similar to that used in constructing automobiles, uses steel panels which are clipped together. According to another technique described in British Patent Specification No. 1,493,610, the ceiling portion of the cab is reenforced in order to make the ceiling strong enough to support the cab load.

DISCLOSURE OF INVENTION

Among the objects of the present invention is to provide an extremely lightweight, low cost, easy to fabricate and disassemble elevator cab.

According to the present invention, an elevator cab has a frame which is constructed of a thin skeleton of interconnected steel members; the skeleton may be characterized, in a comparative sense, as being "flimsy". The skeleton comprises vertical and horizontal supports which define the perimeters of the floor, the ceiling, and the cab walls. Panels, constructed of expanded core plastic material, are attached to the vertical supports by strategically placed, two part releasable hook-like fasteners, one part on the panel, the other on the support, and the fasteners are held in compression with each other by bolts which extend through the fasteners. the panel and the support. The panels provide access from the cab to the elevator shaft and the fasteners provide a space between the panels and the vertical members for cab ventilation. Once attached, these wall, floor and ceiling panels cooperate with the frame to create a substantially rigid cab structure. By comparison to materials previously used in elevator systems for the cab walls, the expanded core material or honeycomb material is extremely light and inexpensive. The thickness of the panels is interrelated to the thickness of the frame supports, and the thickness of both is thus selected so that the cab has the rigidity desired for the particular loads the cab will carry in service.

According to an aspect of the present invention, the panels may be constructed of a paper material, such as close cell paper honeycomb, which has been phenolic resin dipped. This particular panel is covered with a fireproof, plastic laminate, which is then aluminum faced.

Also according to the invention, the panel may be constructed of mineralboard core material covered by fire retardant plastic laminate.

The invention thus provides an extremely light and inexpensive elevator cab with easily removable walls.

BRIEF DESCRIPTION OF THE DRAWING

FIG. 1 is a perspective view, partially exploded, of an elevator cab constructed according to the present invention;

FIG. 2 is a plan view of an exemplary channel-like support; and

BEST MODE FOR CARRYING OUT THE INVENTION

Figure 3:
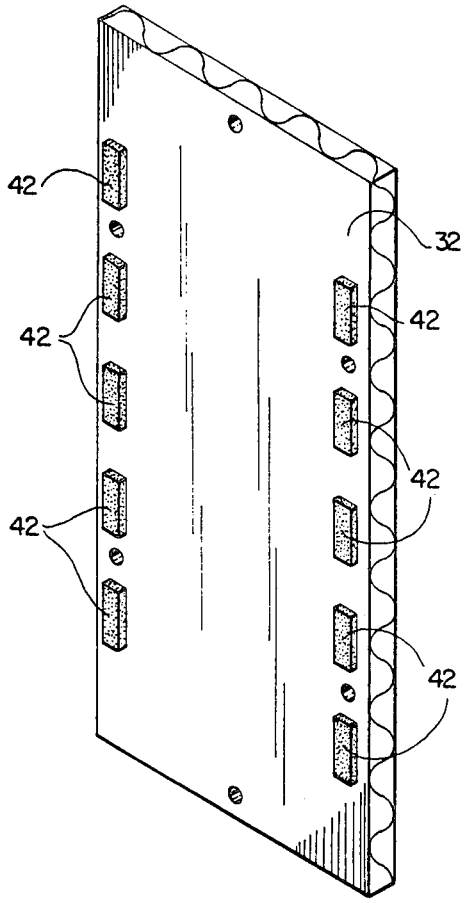
FIG. 3 is an elevational view of a small portion of a wall in the cab.
Figure 4:
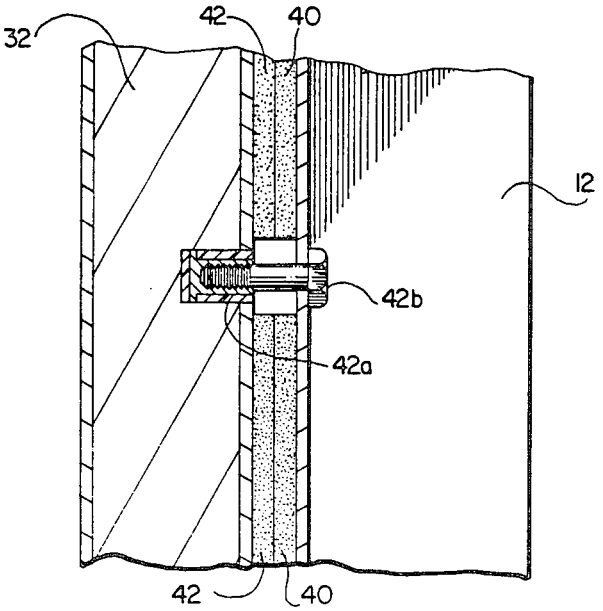

Referring to FIG. 1, an elevator cab 10 is constructed of a plurality of interconnected frame sections or supports 12, 14, 16, 18, 20, which provide a basic skeleton or frame for the cab.

The supports 12 are C-shaped or channeled and spaced between supports 14, which are L-shaped. The vertical and corner supports are attached to the L-shaped horizontal floor supports 16 and L-shaped horizontal ceiling supports 18. Attachment may be by means of bolting, rivoting or welding.

Defining the entranceway to the elevator cab are the vertical supports 20, which are C-shaped also. Certain horizontal and vertical supports, as follows, are not shown in the drawing so that other parts of the cab may be seen in the drawing. A C-shaped horizontal support (like the support 19) extends across the top of the entranceway between the particular corner supports 22 and 24. A vertical support, similar to the particular vertical support 26, extends between the particular horizontal floor support 28 and the ceiling support 30. The two entranceway supports 20 are attached to the mentioned horizontal ceiling support which extends between corner supports 22 and 24. All of the aforementioned horizontal, vertical and corner supports 12, 14, 16, 18, 20 are constructed of rather thin guage steel, for example, 14 guage, and bent into the appropriate channel or L-bracket sections, as indicated in the drawing.

A floor panel section 30 is attached to the floor supports 16. This panel is constructed of expanded core plastic (ECP hereinafter) material of the type described in the following U.S. Pat. Nos.: 3,919,378, 3,919,379, 3,919,380, 3,919,381, 3,919,382, 3,919,445 and 3,919,446.

Attachment is made by bolting the horizontal floor supports 16 to the panel. The panel may consist of two sections of this expanded core plastic material butted together in a single panel.

The ceiling of the cab is also made of a panel (unnumbered) of ECP material, and this panel is attached from the inside of the cab to horizontal support members 18, also by bolting it in place. (The ceiling section is not visible in the drawing to permit exposure of one of the inner panels 32 comprising the cab walls.) As in the case of the floor section 30, the ceiling section may be one panel, or to facilitate its attachment, two or more panels butted together. Once these floor and ceiling sections are in place, decorative coverings, e.g. carpeting for the floor and recessed lighting and ceiling parts, may be attached.

Walls are also provided by means of ECP material in the form of panels 32. These are attached to the vertical supports 12 and 14 by means of releasable hook fasteners having two parts 40, 42. One part 40 is located on the vertical supports; the second part 42 is attached at a corresponding position on the panel. Fasteners of this type are commercially available from 3M Corp., which identifies them as the "Scotchmate Dual Lock Fastening Systems" Type 400. So that the panels 32 may be removed for accessing the exterior of the cab or the shaftway, the hook fasteners should be spaced apart as follows. For decorative purposes, the panels may be covered with plastic laminate material. A steel insert 42A is epoxy bonded into the vertical support behind the fastener "strip" 42 (See FIG. 3), and a bolt 42B that extends through the panel 12 into the fastener is tightened to hold the strips together—in compression. (The hook fasteners characteristically provide significant shear forces, yet are easily separated.) The strips thus provide lateral support primarily between the panel and support that prevents the panels from shifting on the supports, while the bolt assembly holds the strips together.

Owing to the fact that the fasteners, when attached, have a finite depth, there is a consequent airspace between the panel and the vertical supports when the panels are in place, and this space provides ventilation between the frame and panels.

The wall panels do not necessarily have to butt up against each other precisely, and a small vertical gap, approximately $\frac{3}{4}''$, may be maintained between the panels to give the interior impression along the walls of a decorative "hang-on" panel arrangement. The wall panel 33 in the corner of the cab has a rectangular cutout to receive a suitable elevator control panel (not shown) comprising, for example, car call buttons, displays and the like.

In order to achieve a desired level of rigidity, the thickness of the ECP material used in the floors and ceilings and walls should be determined in relation to the rigidity of the skeleton provided simply by the steel supports.

The following example provides a comparison between the structural characteristics of a monoque type frame having a panel constructed in the shape shown in FIG. 2, and the frame in FIG. 1. The panel in FIG. 1 has a width (W) of approximately 24 to 36 inches, a depth (D) of 1.26 inches, and an edge overlap (O) of 0.38 inch. The comparison uses the following equations which are extracted from chart V-3.2 in the text "Compression on Unstiffened Elements Allowable Design Stress $F_c$", in the COLD FORMED STEEL DESIGN MANUAL, 1977 Edition.

$$F_y \text{ (Material Yield Stress)} = F_c \text{ (Allowable Design Compressive Stress)}/0.060. \quad (1)$$

$$W/T \text{ (Flat Width Ratio)} = W \text{ (Panel Width)}/T \text{ (Material Thickness)} \quad (2)$$

Assuming W is equal to 24 to 36 inches and T is equal to 0.0747 inches (14 guage) or 0.0598 inches (16 guage), W/T is in the range of 321 to 602. A ratio less than or equal to 60 is considered an acceptable design in order to minimize torsional or flexural buckling over the large, flat surface of 24 to 36 inches of unsupported sheet metal. In other words, use of sheet metal can be considered effective only if the material allowable stress ($F_y$) are reached before failure by torsional/flexural buckling.

The same characteristics, however, can be achieved using the frame arrangement shown in FIG. 1, and the following demonstrates this. Assuming the width of a single vertical channel-shaped support to be 4 inches and its depth 1.5 inches, W/T is equal to 53.54 (equation 2), which is in other words less than 60. Similarly, if the L-shaped vertical supports are 4 inches on each side, W/T is also less than or equal to 60.

Thus, the skeleton design shown in FIG. 1 meets the test ratios for flat surfaces without the use of a significant amount of unnecessary steel. To put it another way, the skeleton design in FIG. 1 is structurally effective because the material use is held in a stabilized configuration.

A cab constructed according to the following dimensions using expanded core plastic material has been found to achieve a net weight savings of approximately 1285 pounds for a 2500 pound duty, compared to conventional designs using standard walls. The overall cab width is 80", and the cab depth is 51". The panels, including the floor and wall panels, are constructed of $\frac{3}{4}''$ to 1" thick ECP material that may be faced with high pressure plastic laminate on one side (the interior side) and sheet aluminum between 0.032 inch and 0.024 inch on the other side (the shaft side). The panel widths in the walls may vary from between 22" to 44". The corner angles (the vertical supports 14 in the corners of the cab) are 4" by 4" (D3,D4), constructed of 14 guage steel and 96" long. The channels (the vertical supports 12 between the corners) are made 4" wide by $1\frac{1}{2}''$ (D1,D2), also 14 guage steel and also 96" long. The horizontal supports (the supports 18 that define the floor and ceiling perimeters) are constructed of 5" by $2\frac{1}{2}''$ (D5,D6) L-brackets or corner angles, and 14 guage steel. Their lengths are variable (i.e. selectable) depending upon each support's location in the cab.

The ECP panels are just one type of panel which may be used according to the present invention. They may also be made of laminate covered honeycomb paper which has been phenolic resin dipped. The honeycomb is covered with fire retardant plastic laminate (facing the interior of the cab), which is then covered with aluminum. Experimental results indicate that, to achieve adequate rigidity and fire protection, the honeycomb cell size should be in a range of 0.05 to 0.25 inch (for adequate impact resistance), and the fire retardant plastic laminate should be approximately 0.062 inch, which provides a flame spread of $\leqq 25$ (using ASTM E-84 standards). The aluminum face, which faces the shaft, should be about 0.032 inch. Such honeycomb material is available from Honeycomb Construction Services, Ontario, Canada.

Low density mineralboard core material, as manufactured by Conwed Industrial Board of Minnesota, may also be used to construct panels by covering the low density board with fire retardant plastic laminate sheeting.

A polycarbonate plastic honeycomb core material, manufactured by Plascore Inc. of Michigan, may also be used as a substitute for expanded core material. It, too, should be covered with an aluminum facing that faces the shaft.

All of these alternative approaches share a common concept: A low density core material is constructed to have adequate rigidity and is then covered with a thin layer of high density, fire retardant material that faces the cab interior, and aluminum covering that faces the shaft.

Although the invention has been shown and described with respect to exemplary embodiments and examples thereof, it should be understood by those skilled in the art that, in addition to the foregoing, other various changes, omissions and additions may be made therein and thereto, without departing from the true scope and spirit of the invention.

I claim:

1. An elevator cab comprising:

a frame comprising vertical supports and horizontal supports interconnected together, the vertical supports defining the cab walls, the horizontal supports defining the cab floor and ceiling, and characterized by:

panels attached to the frame and comprising paper honeycomb, phenolic resin dipped, that is covered by fire retardant plastic laminate on the side facing the cab interior, and by aluminum on the side facing the shaft, first fastener assemblies located at vertically spaced apart points between each panel and a vertical support for holding the panels in position on the support, each first fastener assembly comprising hook-like fasteners having two joinable sections, one attached to the panel, the other to the vertical support, and second fastener assemblies disposed between vertically adjacent first fastener assemblies, for holding the joinable sections in compression, each second fastener assembly comprising a nut embedded in the panel and a bolt that extends through the vertical support into the nut, said vertical supports comprising channel supports which are U-shaped and L-shaped supports, the L-shaped supports defining the corners of the cab wall, the channel supports being disposed between said L-shaped supports for defining a cab wall frame between said corners and there being at least two such channel supports for the wall opposite the cab entrance and one channel support between adjacent panels on the same cab wall, said channel support having its widest solid surface facing inward to the cab interior, to which surface said first fastener assembly is attached and through which said bolt extends, and its open end facing the elevator hoistway walls, each channel support having a flat width ratio of 60 or less, wherein the flat width ratio is equal to the support width over the support thickness, and said horizontal supports including L-shaped supports which are attached to each vertical support.

2. A cab according to claim 1, characterized in that the honeycomb has a cell size between 0.05–0.25 inch, and the laminate is at least 0.062 inch.

3. A cab according to claim 2, characterized in that:

said L-shaped supports at the corners are no more than 4.00 by 4.00 inches and no more than 14 guage steel, and said L-shaped supports are no more than 4.00 inches wide and 1.75 inches deep and no more than 14 guage steel.

* * * * *